US010898779B1

(12) United States Patent
Son

(10) Patent No.: US 10,898,779 B1
(45) Date of Patent: Jan. 26, 2021

(54) GOLF PUTT TRAINING DEVICE

(71) Applicant: Richard Chung Son, Seoul (KR)

(72) Inventor: Richard Chung Son, Seoul (KR)

( * ) Notice: Subject to any disclaimer, the term of this patent is extended or adjusted under 35 U.S.C. 154(b) by 0 days.

(21) Appl. No.: 17/068,385

(22) Filed: Oct. 12, 2020

(51) Int. Cl.
*A63B 69/36* (2006.01)

(52) U.S. Cl.
CPC .... *A63B 69/36211* (2020.08); *A63B 69/3676* (2013.01)

(58) Field of Classification Search
CPC ..... A63B 69/3676; A63B 69/3621; A63B 69/36211; A63B 69/3685; A63B 69/3629; A63B 69/3667
USPC ..... 473/195, 210, 229, 257, 261, 265, 266, 473/269
See application file for complete search history.

(56) References Cited

U.S. PATENT DOCUMENTS 5,273,284 A 12/1993 Montgomery
6,129,639 A * 10/2000 Brock ..... A63B 69/36211 473/260
7,997,995 B2 * 8/2011 Willis ..... A63B 69/3676 473/265
9,126,092 B2 * 9/2015 Deacon ..... A63B 69/3621
2005/0277482 A1 12/2005 Bennett
2006/0183565 A1 * 8/2006 Tolson ..... A63B 69/3614 473/261
2016/0045807 A1 * 2/2016 Holland ..... A63B 69/3676 473/266

FOREIGN PATENT DOCUMENTS

KR 100621515 9/2006
KR 2020110007312 7/2011

* cited by examiner

*Primary Examiner* — Nini F Legesse
(74) *Attorney, Agent, or Firm* — IPLA P.A.; James E. Bame

(57) ABSTRACT

A portable device for practicing a golf putting stroke, includes: a base member having a front part and a rear part, where the rear part has an elongate opening; a lower elongate member having an auxiliary support with a first and second rails extending downward, the first and second rails detachably engaged into the first and second grooves; an upper elongate member having a protrusion where an elongate through-hole is vertically formed along the upper elongate member, the protrusion having a vertical elongate opening through an outer end of the protrusion; and a connecting member with a front end of the top part substantially opened side to side other than a first guide rail, the bottom part of the connecting member substantially opened front to rear other than a second guide rail.

17 Claims, 5 Drawing Sheets

GOLF PUTT TRAINING DEVICE

BACKGROUND

This invention relates to a golf putt training device and, more particularly, to a portable device for practicing a golf putting stroke, which enables a golfer to effectively practice a putting stroke to achieve a bodily sense of a straight line putting.

A market demand for a putting practice tool has been on the increase to meet needs of golfers trying to improve a putting skill and accuracy of putting strokes. Numerous prior art teachings exist pertaining to practicing golf putt training tools. Mostly focused on in the prior art has been a target based practicing like practicing a putting stroke using a hole or a hole cup. Another popular approach to practice a putting stroke directs to using split pieces of practice aids like manually moving a straight guide piece along a ball pass.

A disadvantage of the conventional putting practice tools would be frequently focusing the putting practice on a ball target, which tends to missing importance of a straight putting stroke that couldn't be more emphasized in golf professionals.

Another disadvantage of the prior art teachings would be missing significance of a ball concentration from the very start of a putting stroke by more focusing on split tools being spread and collected each time of practicing, thus letting a golfer lose the ball concentration which helps direct a ball as straight as possible from the line up and start sequences of touch, pushing or hitting the ball.

SUMMARY OF THE INVENTION

The present invention is contrived to overcome the conventional disadvantages. Accordingly, an objective of the present invention is to provide a portable device for practicing a golf putting stroke that allows a golfer to carry with ease and practice golf putting whenever he or she feels like practicing a golf putting stroke taking advantage of an easy assembly factor realized in this improvement.

Another objective is to provide a portable device for practicing a golf putting stroke enabling a golfer to develop and improve a bodily sense of a straight line putting stroke, thus satisfying most strong needs of golfers.

A still another objective is to provide a portable device for practicing a golf putting stroke enabling a golfer to practice a straight putting stroke while closely monitoring the putter's face line up and ball movement along a guide hole and an elongate straight through-hole, thus maximizing a user satisfaction.

In order to achieve these and other objectives, a portable device for practicing a golf putting stroke according to the present invention includes a base member having a front part and a rear part, wherein the front part has a first and second grooves parallel to each other, wherein the first and second grooves are formed in an upper portion of the front part, wherein the rear part has an elongate opening perpendicular to the first and second grooves.

Further included are a lower elongate member having an auxiliary support extending from a middle part of the lower elongate member, wherein the auxiliary support has a first and second rails extending downward from a bottom portion of the auxiliary support, wherein the first and second rails are detachably engaged into the first and second grooves; and an upper elongate member having a protrusion extending from a middle part of the upper elongate member, wherein an elongate through-hole is vertically formed along the upper elongate member, wherein the protrusion has a vertical elongate opening through an outer end of the protrusion.

Still further included is a connecting member having a top part, a bottom part, and a middle part linked between the top and bottom parts, wherein a front end of the top part is substantially opened side to side other than a first guide rail such that the first guide rail is detachably engaged into the vertical elongate opening, wherein the bottom part of the connecting member is substantially opened front to rear other than a second guide rail such that the second guide rail is detachably engaged into the elongate opening of the base member to form an acute angle between overall directions of the base member and the middle part of the connecting member, wherein an upper front portion of the middle part of the connecting member is formed inclined toward the upper elongate member such that the outer end of the protrusion is vertically aligned with the lower elongate member therebelow when assembled.

The portable device for practicing a golf putting stroke may further include a third rail extending downward from the bottom portion of the auxiliary support to become engaged to a front edge line of the base member, where the front edge line of the base member is substantially depressed toward the rear part of the base member. The base member has a base opening vertically through the first and second grooves. a gap between the first and second rails is larger than that between the second and third rails.

The upper elongate member has a vertical hole through an inner end of the protrusion, wherein the vertical hole is formed in a circle. The upper elongate member has a bridge dividing the elongate through-hole in half. The elongate through-hole may be either 5 (five) millimeters or 7 (seven) millimeters in width. The elongate opening in the rear part of the base member is shaped in a reversed "T". The second guide rail of the bottom part of the connecting member is shaped in a reversed "T".

A top to bottom thickness of the middle part of the connecting member becomes gradually narrower from the bottom part toward the top part of the connecting member. The middle part of the connecting member further comprises an upper layer, a lower layer, and a middle layer linking the upper and lower layers, wherein the middle layer is formed substantially thinner side to side than any of the upper and lower layers.

The upper elongate member is parallel to the lower elongate member when assembled. The base, lower elongate lower, upper elongate upper, and connecting members are each made of either a synthetic organic compound or a semi-synthetic organic compound.

BRIEF DESCRIPTION OF THE INVENTION

These and other features, aspects and advantages of the present invention will become better understood with reference to the accompanying drawings, wherein.

DETAILED DESCRIPTION OF THE PRESENT INVENTION

Figure 1:
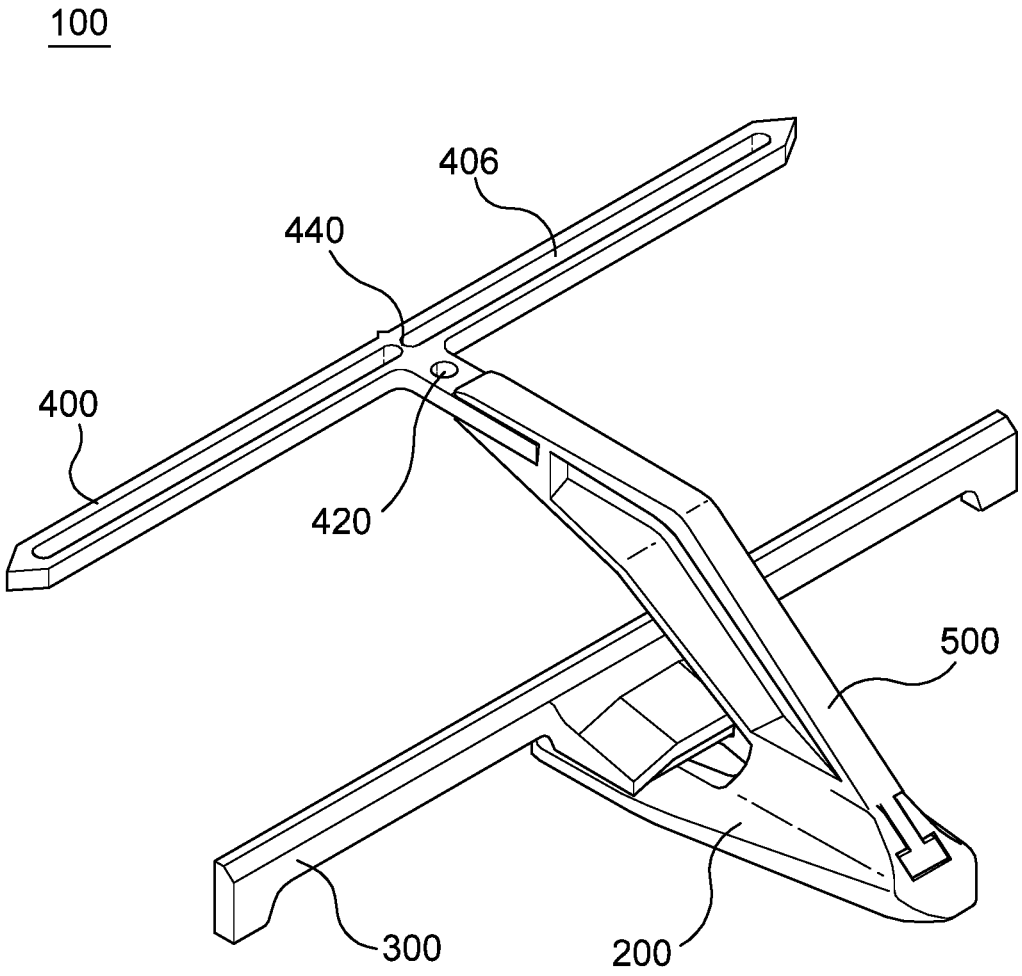
FIG. 1 is a perspective view showing a portable device for practicing a golf putting stroke according to the present invention.
Figure 2:
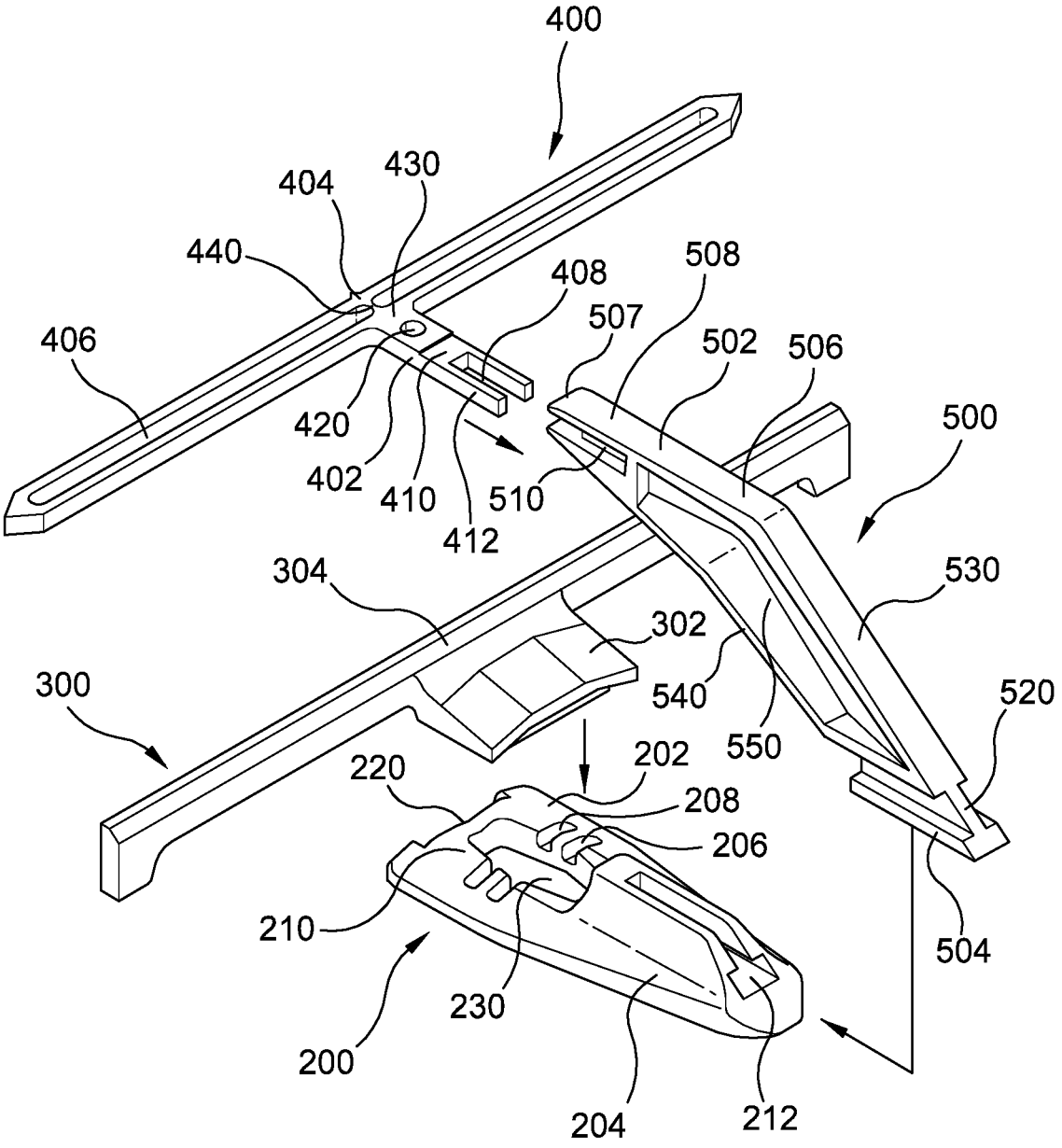
FIG. 2 is an exploded view of the portable device for practicing a golf putting stroke according to the present invention to show assembly steps.
Figure 3:
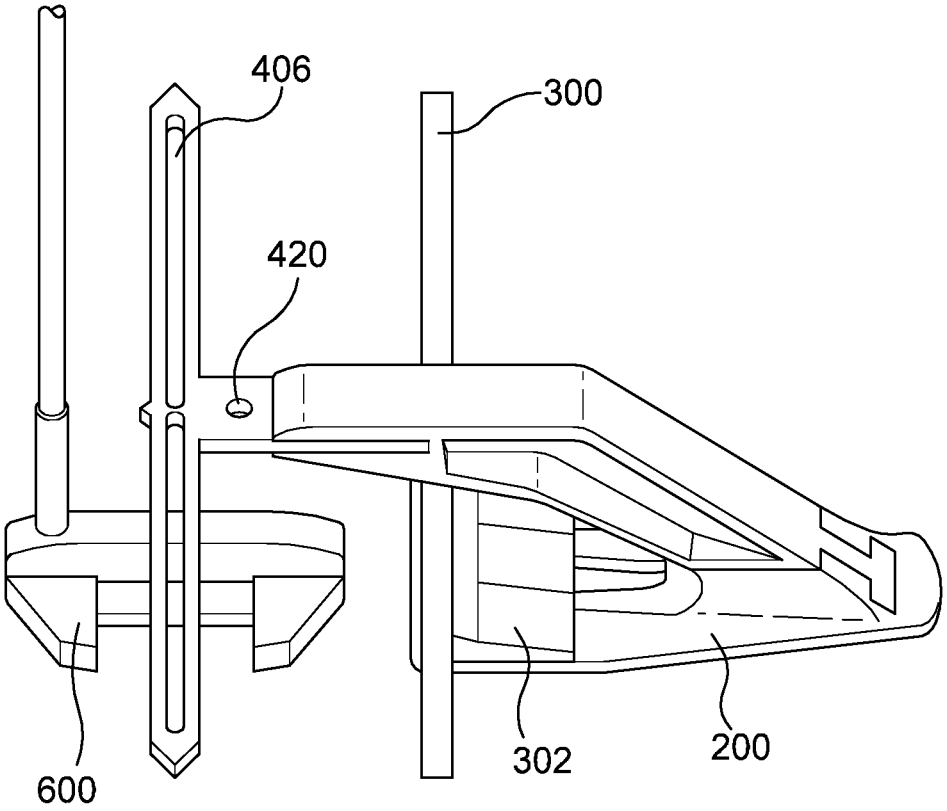
FIG. 3 is another perspective view showing the portable device for practicing a golf putting stroke according to the present invention with a putter.
Figure 4:
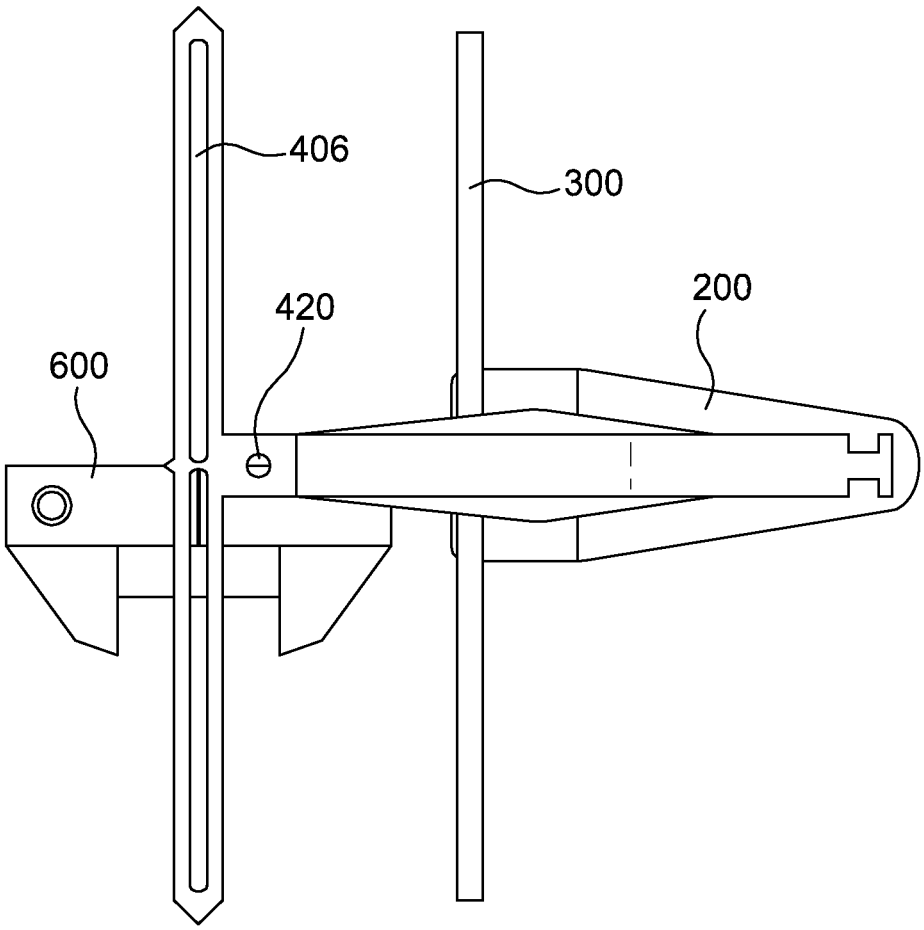
FIG. 4 is a top plan view of FIG. 1 with a putter.
Figure 5:
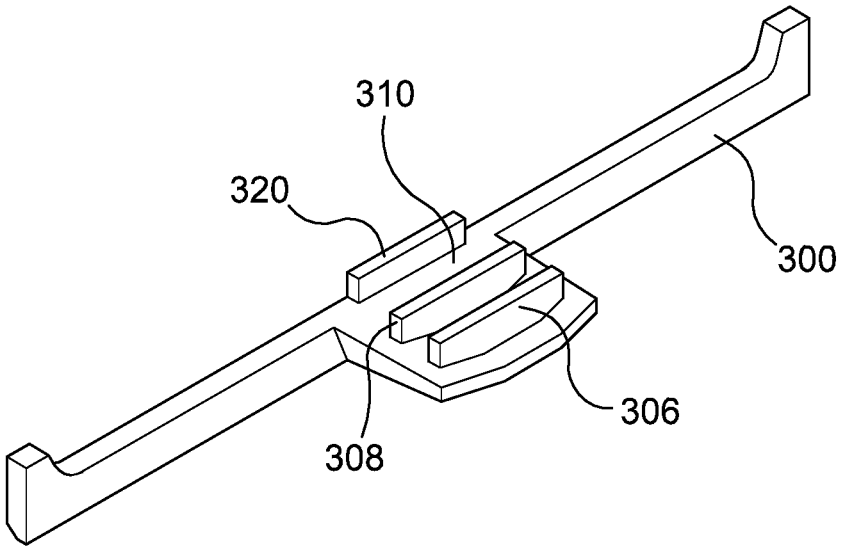
FIG. 5 is a flipped-over perspective view of a lower elongate member according to the present invention.

With reference to the accompanying drawings, a portable device 100 for practicing a golf putting stroke according to the present invention comprises a base member 200, a lower elongate member 300. an upper elongate member 400, and a connecting member 500.

The portable golf putt practicing device 100 can be easily assembled into a whole using the base member 200, the lower elongate member 300. the upper elongate member 400, and the connecting member 500.

The base member 200 is shaped substantially flat and rectangular with a flat bottom to stably sit on a floor, a ground or a green. The base member 200 has a front part 202 and a rear part 204. In this construction, the front part 202 has a first groove 206 and a second groove 208 being parallel to each other. The first and second grooves 206, 208 are preferably formed in an upper portion 210 of the front part 202. The rear part 204 has an elongate opening 212 perpendicular to the first groove 206 and the second groove 208.

The lower elongate member 300 is formed in a substantially straight format to stably support the portable putt practicing device 100 together with the base member 200 when assembled. The lower elongate member 300 has an auxiliary support 302 extending from a middle part 304 of the lower elongate member 300. Here, the auxiliary support 302 has a first rail 306 and a second rail 308 respectively extending downward from a bottom portion 310 of the auxiliary support 302. The first and second rails 306, 308 are detachably engaged into the first and second grooves 206, 208 of the base member 200. In specific, the lower elongate member 300 is raised up and vertically lined up above the base member 200 and then getting lowered so that the first and second rails 306, 308 of the lower elongate member 300 become detachably engaged into the first and second grooves 206, 208 of the base member 200.

The upper elongate member 400 has a protrusion 402 extending from a middle part 404 of the upper elongate member 400. In a preferred version, an elongate through-hole 406 is vertically formed along the upper elongate member 400. The protrusion 402 has a vertical elongate opening 408 through an outer end 410 of the protrusion 402. Thus, the vertical elongate opening 408 forms a pair of prongs 412 side to side so that the vertical elongate opening 408 remains between the prong pair 412.

The connecting member 500 has a top part 502, a bottom part 504, and a middle part 506 linked between the top and bottom parts 502, 504. A front end 508 of the top part 502 is substantially opened side to side other than a first guide rail 510 such that the first guide rail 510 is detachably engaged into the vertical elongate opening 408 of the protrusion 402 of the upper elongate member 400. Meanwhile, the bottom part 504 of the connecting member 500 is substantially opened front to rear other than a second guide rail 520 such that the second guide rail 520 is detachably engaged into the elongate opening 212 of the base member 200 to form an acute angle between overall directions of the base member 200 and the middle part 506 of the connecting member 500.

In a preferred version, an upper front portion 507 of the middle part 506 of the connecting member 500 is formed inclined toward the upper elongate member 400 such that the outer end 410 of the protrusion 402 is vertically aligned with the lower elongate member 300 therebelow when assembled. This construction is to allow a user practicing golf putting to align the butter head 600 below the upper elongate member 400.

The portable golf putt practicing device 100 may further comprises a third rail 320 extending downward from the bottom portion 310 of the auxiliary support 302 of the lower elongate member 300 so as to become engaged to a front edge line 220 of the base member 200. The third rail 320 together with the first and second rails 306, 308 serves to further improve stability of the golf putt practicing device 100 when assembled. In order to maximize product reliability, the front edge line 220 of the base member 200 can be substantially depressed toward the rear part 204 of the base member 200.

The base member 200 may be provided with a base opening 230 formed vertically through the first and second grooves 206, 208. In a preferred version. In order to improve stability when assembled, a gap between the first and second rails 306, 308 is larger than that between the second and third rails 308, 320.

The upper elongate member 400 has a vertical hole 420 through an inner end 430 of the protrusion 402. In this construction, the vertical hole 420 is better formed in a circle. The upper elongate member 400 may have a bridge 440 dividing the elongate through-hole 406 in half. To serve for experienced golfers, the elongate through-hole 406 may be formed 5 (five) millimeters in width. Alternately, in order to serve for golf beginners, the elongate through-hole 406 may be formed 7 (seven) millimeters in width.

The elongate opening 212 in the rear part 204 of the base member 200 may be shaped in a reversed "T", and the second guide rail 520 of the bottom part 504 of the connecting member 500 may be shaped in a reversed "T" so that the second guide rail 502 of the connecting member 500 can be reliably, stably and detachably inserted in the elongate opening 212 of the base member 200.

To improve stability when assembled, a top to bottom thickness of the middle part 506 of the connecting member 500 becomes gradually narrower from the bottom part 504 toward the top part 502 of the connecting member 500. The middle part 506 of the connecting member 500 may further comprise an upper layer 530, a lower layer 540, and a middle layer 550 linking the upper and lower layers 530, 540. Here, the middle layer 550 is formed substantially thinner side to side than any of the upper and lower layers 530, 540.

In a preferred embodiment, the upper elongate member 400 is parallel to the lower elongate member 300 when assembled. The base member 200, lower elongate member 300, upper elongate member 400, and connecting member 500 are each made of either a synthetic organic compound or a semi-synthetic organic compound.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable device for practicing a golf putting stroke, comprising:

a base member having a front part and a rear part, wherein the front part has a first and second grooves parallel to each other, wherein the first and second grooves are formed in an upper portion of the front part, wherein the rear part has an elongate opening perpendicular to the first and second grooves;

a lower elongate member having an auxiliary support extending from a middle part of the lower elongate member, wherein the auxiliary support has a first and second rails extending downward from a bottom portion of the auxiliary support, wherein the first and second rails are detachably engaged into the first and second grooves;

an upper elongate member having a protrusion extending from a middle part of the upper elongate member, wherein an elongate through-hole is vertically formed along the upper elongate member, wherein the protrusion has a vertical elongate opening through an outer end of the protrusion; and a connecting member having a top part, a bottom part, and a middle part linked between the top and bottom parts, wherein a front end of the top part is substantially opened side to side other than a first guide rail such that the first guide rail is detachably engaged into the vertical elongate opening, wherein the bottom part of the connecting member is substantially opened front to rear other than a second guide rail such that the second guide rail is detachably engaged into the elongate opening of the base member to form an acute angle between overall directions of the base member and the middle part of the connecting member, wherein an upper front portion of the middle part of the connecting member is formed inclined toward the upper elongate member such that the outer end of the protrusion is vertically aligned with the lower elongate member therebelow when assembled.

2. The portable device for practicing a golf putting stroke according to claim 1, further comprising a third rail extending downward from the bottom portion of the auxiliary support to become engaged to a front edge line of the base member.

3. The portable device for practicing a golf putting stroke according to claim 2, wherein the front edge line of the base member is substantially depressed toward the rear part of the base member.

4. The portable device for practicing a golf putting stroke according to claim 1, wherein the base member has a base opening vertically through the first and second grooves.

5. The portable device for practicing a golf putting stroke according to claim 1, wherein a gap between the first and second rails is larger than that between the second and third rails.

6. The portable device for practicing a golf putting stroke according to claim 1, wherein the upper elongate member has a vertical hole through an inner end of the protrusion, wherein the vertical hole is formed in a circle.

7. The portable device for practicing a golf putting stroke according to claim 1, wherein the upper elongate member has a bridge dividing the elongate through-hole in half.

8. The portable device for practicing a golf putting stroke according to claim 1, wherein the elongate through-hole is 5 (five) millimeters in width.

9. The portable device for practicing a golf putting stroke according to claim 1, wherein the elongate through-hole is 7 (seven) millimeters in width.

10. The portable device for practicing a golf putting stroke according to claim 1, wherein the elongate opening in the rear part of the base member is shaped in a reversed "T".

11. The portable device for practicing a golf putting stroke according to claim 1, wherein the second guide rail of the bottom part of the connecting member is shaped in a reversed "T".

12. The portable device for practicing a golf putting stroke according to claim 1, wherein the elongate opening in the rear part of the base member is shaped in a reversed "T" and the second guide rail of the bottom part of the connecting member is shaped in a reversed "T".

13. The portable device for practicing a golf putting stroke according to claim 1, wherein a top to bottom thickness of the middle part of the connecting member becomes gradually narrower from the bottom part toward the top part of the connecting member.

14. The portable device for practicing a golf putting stroke according to claim 1, wherein the middle part of the connecting member further comprises an upper layer, a lower layer, and a middle layer linking the upper and lower layers, wherein the middle layer is formed substantially thinner side to side than any of the upper and lower layers.

15. The portable device for practicing a golf putting stroke according to claim 1, wherein the upper elongate member is parallel to the lower elongate member when assembled.

16. The portable device for practicing a golf putting stroke according to claim 1, wherein the base, lower elongate lower, upper elongate upper, and connecting members are each made of a synthetic organic compound.

17. The portable device for practicing a golf putting stroke according to claim 1, wherein the base, lower elongate lower, upper elongate upper, and connecting members are each made of a semi-synthetic organic compound.

* * * * *